US005354233A

United States Patent [19]

Mandy et al.

[11] Patent Number: 5,354,233

[45] Date of Patent: Oct. 11, 1994

[54] EMERGENCY VENTILATION SYSTEM FOR ELEVATOR CAB

[75] Inventors: Terry R. Mandy, Troy; Robert R. Mandy, Bingham Farms; Nazar Bally, Southfield, all of Mich.

[73] Assignee: Man-D-Tec, Inc., Scottsdale, Ariz.

[21] Appl. No.: 955,416

[22] Filed: Oct. 2, 1992

[51] Int. Cl.[5] ..... F24F 7/007

[52] U.S. Cl. ..... 454/68; 187/393; 187/414; 454/343

[58] Field of Search ..... 236/49.3; 454/68, 229, 454/239, 343; 307/66; 187/1 R; 362/76, 149, 150; 52/39

[56] References Cited

U.S. PATENT DOCUMENTS

| | | | |
|---|---|---|---|
| 1,767,988 | 6/1930 | Knapp | 454/68 |
| 4,032,828 | 6/1977 | Strobl et al. | 307/66 X |
| 4,241,871 | 12/1980 | Newell, III et al. | 454/238 X |
| 4,751,398 | 6/1988 | Ertz, III | 307/66 |
| 4,875,553 | 10/1989 | Smith et al. | 187/1 R |
| 4,905,579 | 3/1990 | Dame | 454/238 |
| 4,977,818 | 12/1990 | Taylor et al. | 454/342 |
| 5,123,875 | 6/1992 | Eubank et al. | 454/342 |

*Primary Examiner*—Harold Joyce

*Attorney, Agent, or Firm*—Reising, Ethington, Barnard, Perry & Milton

[57] ABSTRACT

An emergency ventilation system for elevator cabs includes a low voltage power source defined by the secondary winding of a stepdown transformer having its primary winding connected across a primary power source. An emergency power circuit has a single pole, double throw relay located in a normal power position when the primary power source is "on" wherein it connects the low voltage power source to the ventilating fans. The single pole, double throw relay has an emergency position wherein it is positioned to connect the emergency battery source to the ventilating fans so as to operate them independently of the primary power source for providing uninterrupted ventilation to the elevator cab.

2 Claims, 1 Drawing Sheet

EMERGENCY VENTILATION SYSTEM FOR ELEVATOR CAB

FIELD OF THE INVENTION

This invention relates to ventilation systems and more particularly to emergency ventilation systems for elevator cabs and other spaces that require continuous ventilation even in the event of power failure of a main power source.

BACKGROUND OF THE INVENTION

Elevator cabs presently include a motor driven fan mounted centrally on the cab roof. The motor driven fan typically includes a suitable electric motor that is operable when connected across a 110 VAC power source to drive a fan blade in the ventilating system to draw air from the elevator shaft for flow through the elevator cab and back to the shaft. Such elevator ventilation systems can include an emergency ventilation system that has a separate DC motor driven fan connected to a separate DC power source when the main AC power source fails. The DC motor driven fan is operable to provide a back-up ventilation when the AC motor driven fans are rendered inoperative because of main power failure.

Present elevator ventilation systems for normal and emergency operation, therefore require two separate air flow delivery systems, one including an AC motor driven fan and the other including a separate DC motor driven fan and wherein the separate air flow delivery systems are selectively operated in accordance with whether or not a main AC power supply has failed.

In many other systems for ventilating elevator cabs only one motor driven fan is connected to the regular AC power source. The air discharge from each such motor driven fan is directed through a single outlet hole in the center of the elevator cab roof. Most elevators, however, have a drop ceiling that restricts the flow of such discharge through the elevator compartment and outlet hole.

SUMMARY OF THE INVENTION

An object of the present invention is to provide an emergency ventilation system for use in elevator cabs that includes motor driven fans (ventilating fans) operative to supply continuous ventilation during normal operation and when a main power supply fails by use of one system including the same ventilating fans operative during both normal and emergency operating conditions and arranged to discharge air continuously through the same outlets out of the passenger compartment of the elevator during both normal and emergency operating conditions.

Another object of the present invention is to provide an emergency ventilating system that uses the same ventilating fans to supply both normal and emergency ventilation to the passenger compartment of the elevator wherein the ventilation system includes a ventilating fan on the cab roof of an elevator near both sides of the elevator cab at a location that permits upward flow around the edges of a drop ceiling without any substantial reduction or restriction of discharge flow from the same fans.

A feature of the present invention is that a secondary winding of a stepdown transformer provides regulated power to one or more fans and wherein the same transformer provides power to a regulated charging circuit to maintain the charge on a battery for use during emergency ventilating in which the battery is connected by switch means to the same one or more ventilating fans that provide ventilation during both normal and emergency operating conditions.

Another feature of the present invention is to provide a thermistor in circuit with the ventilation fans operative to reduce current flow to the ventilation fans in accordance with the temperature in an elevator cab so as to regulate demand for airflow while reducing fan noise and the power requirements during emergency operation thereby to extend the time during which an emergency battery will be operative following failure of a primary power source.

Still another feature of the present invention is a power supply for the fans that includes a low voltage power supply source defined by the secondary winding of a stepdown transformer having its primary winding connected across a primary or main power source and the low voltage power supply is connected to the ventilating fans through a regulated power circuit and an energizable relay. When the main power supply fails or is off, the relay is operative to connect an emergency battery source to the ventilation fans for powering them during the "emergency". A low voltage protection circuit monitors battery voltage and is operative to disconnect emergency battery power to the ventilating fans when the battery voltage falls below a undesired "deep discharge point".

Still another feature of the invention is to regulate airflow in the aforesaid systems by incorporating a thermistor into the fans to sense ambient temperature and to operate the ventilating fans at reduced speeds for reducing airflow into the elevator compartment until a predetermined temperature increase is sensed so as to reduce noise during normal operation and to reduce emergency battery power drain during emergency operation.

DETAILED DESCRIPTION OF THE INVENTION

Figure 1:
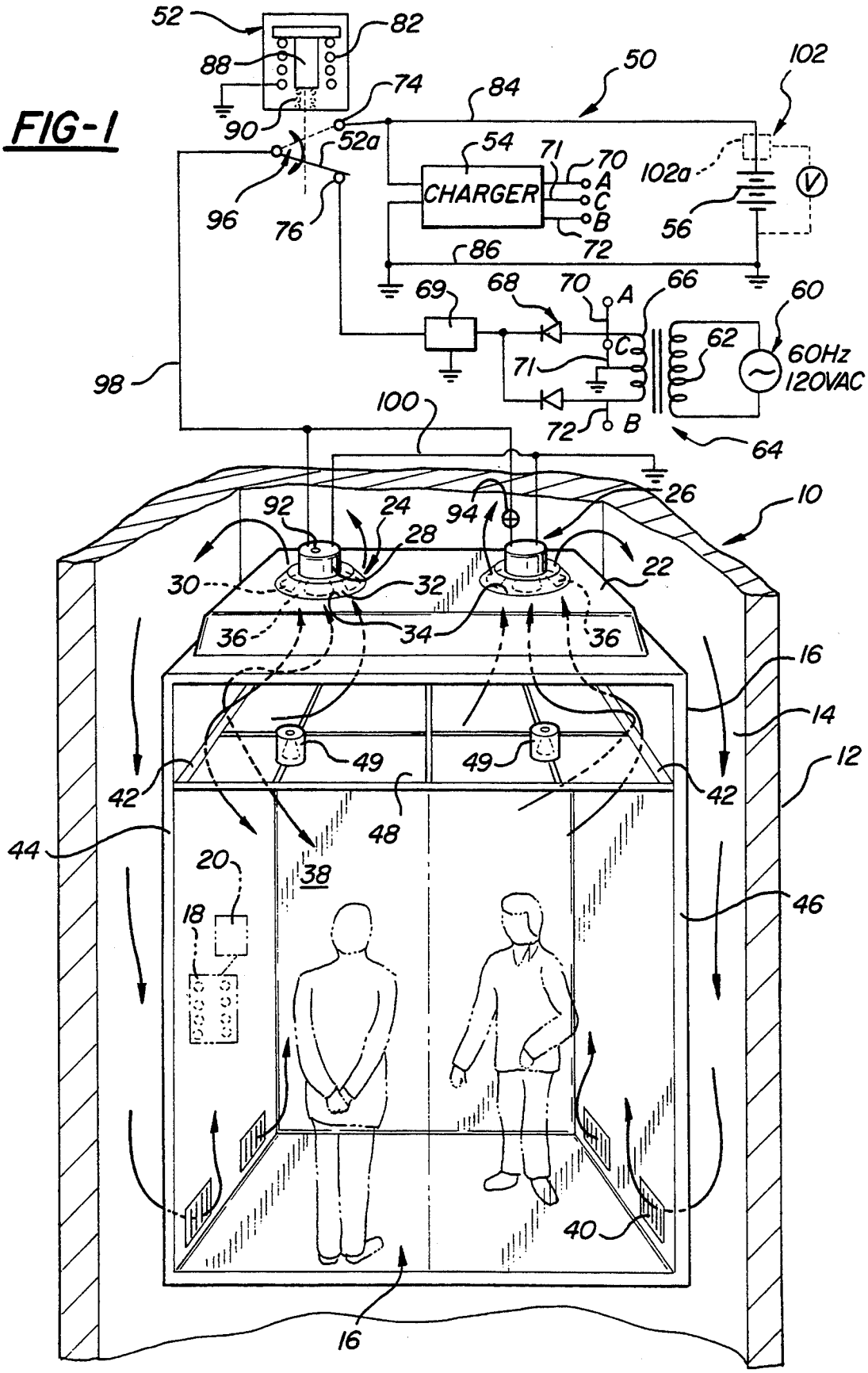
FIG. 1 is a diagrammatic view of an elevator cab ventilation system according to the present invention.

An emergency ventilation system 10 in association with an elevator 12 is shown in FIG. 1. The elevator 12 has a elevator shaft 14 in which is located an elevator cab 16. The elevator cab 16 is operated by a control system 18 of a known kind, forming no part of the present invention, to condition a drive system 20, again of a known kind, forming no part of the present invention. A cab roof 22 has a pair of motor driven fans 24, 26. In the illustrated arrangement of the emergency ventilating system 10, the motor driven fans 24, 26, each include a drive motor 28 connected to a fan 30. The fan 30 includes a shroud 32 that is supported with respect to an outlet opening 34 through the cab roof 22. The fan 30 has an inlet 36 through which air is drawn from the elevator cab interior 38 for discharge into the elevator shaft 14 from the elevator cab 16. The air enters the elevator cab through door or other vent openings 40 near the floor for flow back to the elevator shaft 14 through the openings 34.

In accordance with one aspect of the invention the motor driven fans 24, 26 are located at opposite sides of the cab roof 22 such that the openings 34 are located above a gap 42 formed between the side walls 44 and 46 of the elevator cab 16 and the outer periphery of a drop ceiling 48. The drop ceiling 48 is arranged to support lights 49 for illuminating the interior 38. In such arrangement a drop ceiling 48 can be spaced as close as 1 and ½ inches to side walls 44, 46. By locating the openings 34 adjacent the gap 42 between the outer periphery of the drop ceiling 48 and the side walls 44, 46 the discharge air flow from the motor driven fans or ventilating fans 24, 26 passes directly through the passenger compartment with little or no pressure change. Prior art ventilating fans are often located centrally of the cab roof such that discharge flow first passes through the restricted space between the drop ceiling and the cab roof. Such prior art arrangements have substantial pressure drop through the restrict space and accordingly, compared to the present invention, there is less air flow through the compartment for a given motor fan combination. Another way to overcome the pressure drop problem of a centrally mounted ventilating fan is to increase its capacity. However, such increased capacity fans produce an undesirable increase in noise level within the elevator cab interior 38.

In accordance with another aspect of the present invention the ventilating fans 24, 26 are connected to a power circuit 50 that will energize the ventilating fans 24, 26 continuously during both normal power conditions and under emergency power conditions.

As shown in FIG. 1, the power circuit 50 includes a single pole, double throw relay 52 and a battery charger 54 connected to a gel cell (or nickel cadmium) rechargeable battery 56. During normal operation the ventilating fans 24, 26 are connected by relay 52 in a low voltage circuit 58 energized directly from a primary power source 60. In the present case the primary power source is a 110 VAC source. It is connected to the primary winding 62 of a stepdown transformer 64 having its secondary winding 66 connected to the motors 28 that drive the ventilating fans 24, 26. While the motors for ventilating fans are shown as AC motors, they can be DC motors in which case a suitable rectifier 68 and voltage regulator circuit 69 are connected between the secondary winding 66 and the motors of the ventilating fans 24, 26. In the circuit-50, the same step down transformer 64 provides voltage to the regulated charging circuit 54 to maintain battery voltage for use under emergency battery powered energization of the ventilating fans 24, 26.

During normal operation, the power circuit 50 is conditioned such that the relay 52 is connected to complete the circuit from the secondary winding to the ventilating fans 24, 26. The battery charger 54 has its input terminals connected to wires 70, 71, 72 from the secondary winding 66. The battery charger 54 includes a first output terminal connected to a common ground 86 and a second output terminal connected to contact 74 and to battery 56 via conductor 84 for providing a charging circuit between the anode and cathode terminals of the battery 56. The charging circuit is controlled by the relay coil 82 that is connected across the normal power supply 60 to displace an armature 88 in a direction to control the position of contact **52*a* with respect to contacts 74, 76. Under emergency conditions, the power supply 60 is off (it fails) and the coil 82 is thereby deenergized such that the armature 88 is shifted by a spring 90 in a direction to open contact 76 and to close contact 74 for completing an emergency ventilation circuit 96 for energizing the fan motors 28. The emergency ventilation circuit 96 for motors 28 is completed from battery 56 through contact 74, pole 52*a* and conductors 98, 100**.

In accordance with another aspect of the invention, the continuously energized fans 24, 26 can be operated at speeds dependent upon the temperature of air within the passenger compartment. In one case, such temperature dependent operation is obtained by use of a thermistor 92 located in the motor 28 of fan 24. Alternatively, such operation can be obtained by use of a thermistor 94 supplying power to the motor 28 of fan 26.

In accordance with another aspect of the invention, the emergency battery 56 is protected against "deep discharge" damage by use of a low voltage protection circuit 102 that monitors battery voltage and includes a switch **102*a* that disconnects power to the fans 24, 26 when the battery 56** reaches a dangerously low level.

In one working embodiment, the components had the following ratings:

| Item | Rating |
|---|---|
| Motor 28 | 2 at .5 amp each |
| Fans 24, 26 | 2 at 100 CFM each |

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An emergency ventilation system for use in elevator cabs, said emergency ventilation system being of the type having one or more motor driven fans, the improvement comprising:

means connectable to a main power supply for maintaining said motor driven fan(s) continuously operative to supply ventilation through said elevator cab during normal operation and when the main power supply fails;

a stepdown transformer having a primary winding for connection to the main power supply and having a secondary winding;

an emergency battery and a battery charger;

said secondary winding providing power to said one or more fans when the main power supply is operative; said secondary winding also providing power to said battery charger when the main power supply is operative to maintain the charge on said emergency battery for use during emergency ventilating;

and a thermistor coupled to said one or more fans operative to reduce current flow to said one or more fans in accordance with the temperature in the elevator cab so as to regulate airflow while reducing fan noise and the power requirements during emergency operation thereby to extend the time during which said emergency battery will be operative following failure of the mai power source.

2. The emergency ventilation system of claim 1, further comprising said thermistor mounted in said one or more fans to sense ambient temperature and to operate said one or more fans at reduced speeds for reducing airflow through said fans until a predetermined temperature increase is sensed so as to reduce noise during normal operation and to reduce emergency battery power drain during emergency operation.

* * * * *